US012167748B2

(12) United States Patent
Liu

(10) Patent No.: US 12,167,748 B2
(45) Date of Patent: Dec. 17, 2024

(54) HOOKAH

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 536 days.

(21) Appl. No.: 17/376,100

(22) Filed: Jul. 14, 2021

(65) Prior Publication Data

US 2022/0175025 A1 Jun. 9, 2022

(30) Foreign Application Priority Data

Dec. 4, 2020 (CN) ..... 202022876792.2

(51) Int. Cl.

| | |
|---|---|
| ***A24F 1/30*** | (2006.01) |
| ***A24F 1/28*** | (2006.01) |
| ***A24F 1/32*** | (2006.01) |
| ***A24F 7/00*** | (2006.01) |

(52) U.S. Cl.

CPC ..... *A24F 1/30* (2013.01); *A24F 1/28* (2013.01); *A24F 1/32* (2013.01); *A24F 7/00* (2013.01)

(58) Field of Classification Search

None

See application file for complete search history.

(56) References Cited

U.S. PATENT DOCUMENTS

| | | | | |
|---|---|---|---|---|
| 3,605,758 | A * | 9/1971 | Patterson | A24F 1/00 131/183 |
| 2018/0027880 | A1* | 2/2018 | Dong et al. | F16K 31/50 |
| 2018/0192688 | A1* | 7/2018 | Richmond et al. | A24F 9/02 |

FOREIGN PATENT DOCUMENTS

| | | | | |
|---|---|---|---|---|
| CN | 203841103 | * | 9/2014 | |
| CN | 3117725 | * | 1/2017 | A24F 40/10 |
| CN | 108552589 | * | 9/2018 | A24F 7/00 |

* cited by examiner

*Primary Examiner* — Dionne W. Mayes

(74) *Attorney, Agent, or Firm* — MATTHIAS SCHOLL P.C.; Matthias Scholl

(57) ABSTRACT

A hookah including a glass tube and a push rod. The bottom end of the push rod is disposed in the glass tube and is movable in the inner wall of the glass tube when being pushed by force. The tobacco material is loaded in the glass tube and between the bottom end of the push rod and the opening of the glass tube; and smoke produced by the atomization of the tobacco material flows in an air passage of the push rod.

10 Claims, 5 Drawing Sheets

HOOKAH

CROSS-REFERENCE TO RELAYED APPLICATIONS

Pursuant to 35 U.S.C. § 119 and the Paris Convention Treaty, this application claims foreign priority to Chinese Patent Application No. 202022876792.2 filed Dec. 4, 2020, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a hookah.

A conventional hookah includes a tank for accommodation of tobacco material. The tobacco material is loaded into the tank once and for all. Thus, when in use, the smoke amount cannot be controlled through adjusting the supply amount of the tobacco material, which may cause waste. In addition, the outer tube of the conventional hookahs is made of glass, which is easy to break.

SUMMARY

The disclosure provides a hookah, comprising a glass tube and a push rod; a bottom end of the push rod is disposed in the glass tube and is movable in an inner wall of the glass tube when being pushed by force; tobacco material is loaded in the glass tube and between a bottom end of the push rod and an opening of the glass tube; and smoke produced by the atomization of the tobacco material flows in an air passage of the push rod.

In a class of this embodiment, the hookah further comprises an assistant push rod; the assistant push rod sleeves a first half of the push rod; under the action of the assistant push rod, the push rod moves along the inner wall of the glass tube to the opening of the glass tube.

In a class of this embodiment, the hookah further comprises a silicone ring; the silicone ring is disposed in a top opening of the assistant push rod and between the assistant push rod and the push rod, so that owing to the frictional force, the movement of the assistant push rod drives the push rod to move.

In a class of this embodiment, the hookah further comprises a slidable cylinder, a push button, and a screw; the assistant push rod is disposed in the slidable cylinder; a bottom opening of the slidable cylinder is located in a top opening of the glass tube; the push button extends from a guide groove of the slidable cylinder to abut against a top end of the assistant push rod and is fixed by the screw; the push button moves in the guide groove of the slidable cylinder to control the movement of the assistant push rod.

In a class of this embodiment, the hookah further comprises a location pin; the location pin is disposed on the assistant push rod; a plurality of continuous small grooves is disposed on an inner wall of the slidable cylinder and matches the location pin for controlling a forward distance of the assistant push rod to ensure an output amount of the tobacco material for each push.

In a class of this embodiment, the push rod comprises a hollow structure comprising the air passage and a bottom end thereof comprises a plurality of evenly distributed through holes.

In a class of this embodiment, the hookah further comprises an outer air tube, a water-storage glass tube, an inner air tube, and a fixed base; the fixed base is disposed in a top opening of the slidable cylinder; a top end of the push rod is sheathed with the second seal ring disposed in the fixed base; the inner air tube is disposed through the fixed base and communicates with the push rod; the outer air tube sleeves the inner air tube and is fixed on the fixed base; the lower seal ring sleeves the fixed base to seal a bottom opening of the water-storage glass tube; the water-storage glass tube is supported by the fixed base and the outer air tube is disposed in the water-storage glass tube.

In a class of this embodiment, the hookah further comprises an inversion valve disposed on a top of the inner air tube and between the inner air tube and the outer air tube to block the water in the water-storage glass tube and prevent the water from entering the inner air tube.

In a class of this embodiment, the outer wall of the outer air tube comprises at least one through hole for smoke discharge.

In a class of this embodiment, the hookah further comprises a mouthpiece, a check valve, and a mouthpiece holder; a lower part of the mouthpiece holder comprises a vent hole, and an upper part of the mouthpiece holder is disposed in a top opening of the water-storage glass tube; the lower part is fixed in a top opening of the outer air tube; the check valve is disposed in the mouthpiece to block reverse air, thus preventing the air reversing from the mouthpiece from entering the water storage glass tube; and the mouthpiece is disposed on the mouthpiece holder.

In a class of this embodiment, the hookah further comprises a metal tube; after use, the metal tube sleeves the glass tube and the slidable cylinder, and a top end of the metal tube is fixed on the fixed base to protect the glass tube and isolate the air and quench the tobacco material.

DETAILED DESCRIPTION

To further illustrate, embodiments detailing a hookah are described below. It should be noted that the following embodiments are intended to describe and not to limit the disclosure.

Figure 1:
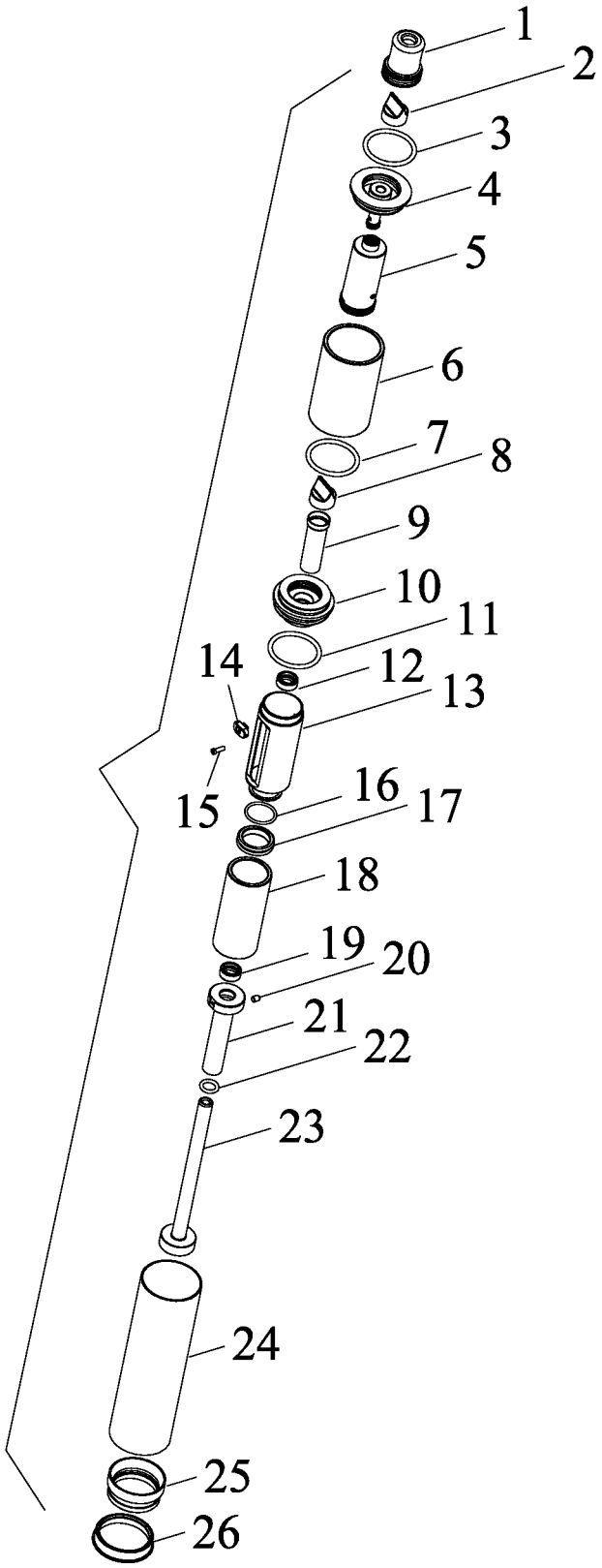
FIG. 1 is an exploded view of a hookah according to one embodiment of the disclosure.
Figure 2:
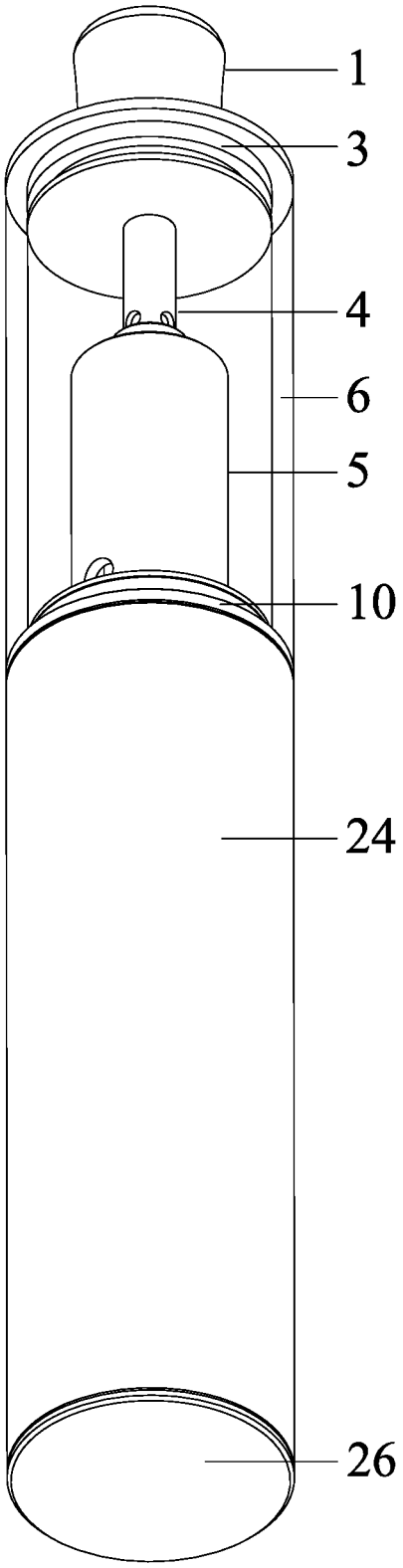
FIG. 2 is a schematic diagram of a hookah according to one embodiment of the disclosure.
Figure 3:
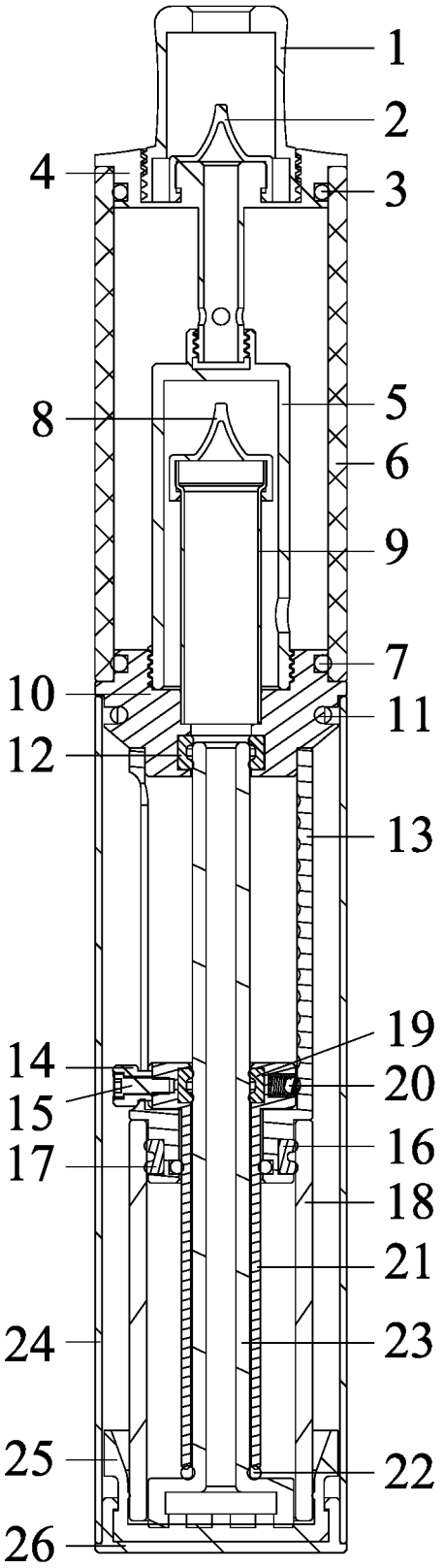
FIG. 3 is a sectional view of a hookah according to one embodiment of the disclosure.
Figure 4:
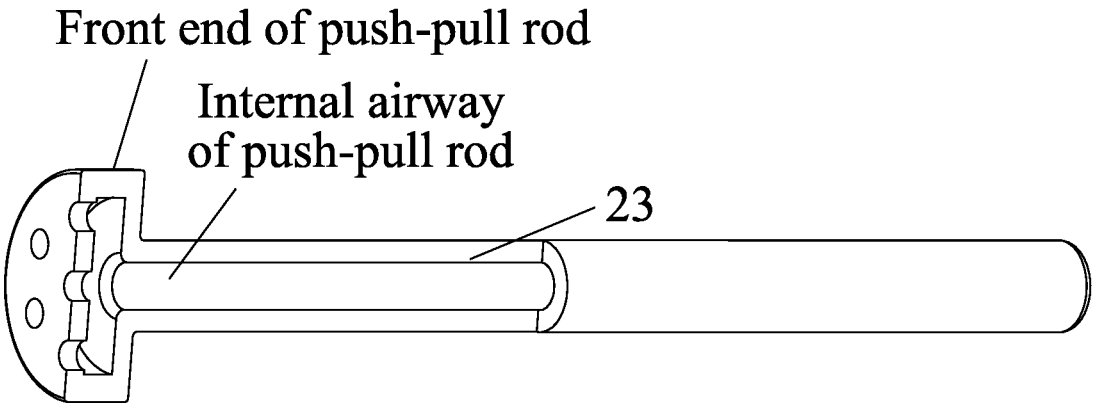
FIG. 4 shows an air passage of a push rod of a hookah according to one embodiment of the disclosure.
Figure 5:
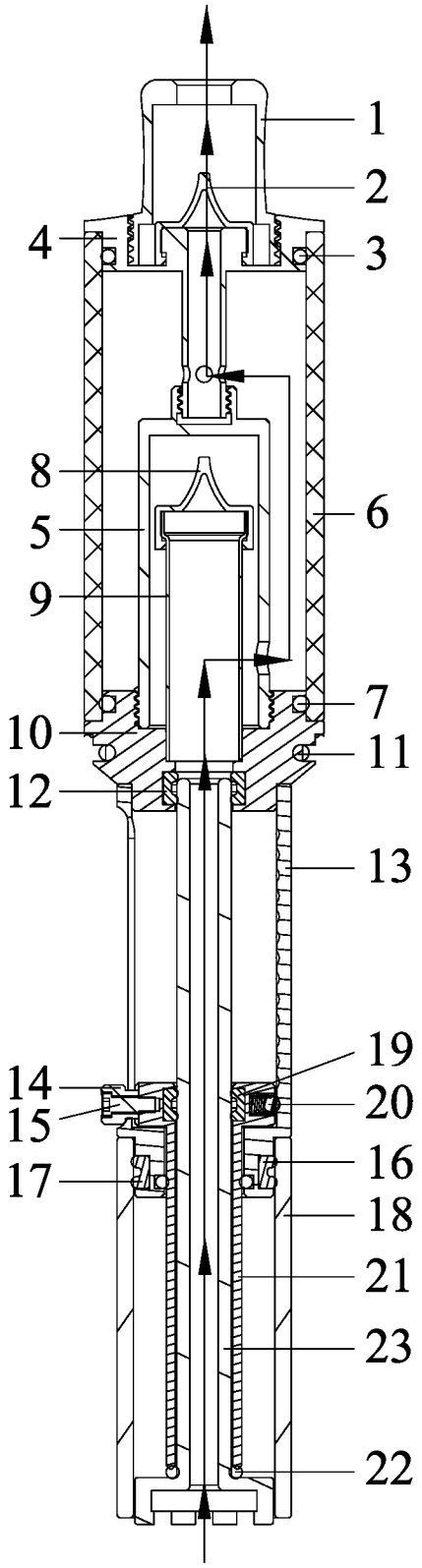
FIG. 5 shows a flow direction of air and smoke of a hookah according to one embodiment of the disclosure.

As shown in FIGS. 1-5, the disclosure provides a hookah comprising a mouthpiece 1, a check valve 2, an upper seal ring 3, a mouthpiece holder 4, an outer air tube 5, a water-storage glass tube 6, a lower seal ring 7, an inversion valve 8, an inner air tube 9, a fixed base 10, a first seal ring 11, a second seal ring 12, a slidable cylinder 13, a push button 14, a screw 15, a third seal ring 16, a fourth seal ring 17, a glass tube 18, a silicone ring 19, a location pin 20, an assistant push rod 21, a fifth seal ring 22, a push rod 23, a metal tube 24, a sixth seal ring 25, and a base 26. The bottom end of the push rod 23 is disposed in the glass tube 18 and is movable in the inner wall of the glass tube 18 when being pushed by force. The tobacco material is loaded in the space between the bottom end of the push rod 23 and the glass tube 18. The smoke produced by the atomization of the tobacco material flows in the air passage of the push rod 23. The assistant push rod 21 sleeves the first half of the push rod 23. Under the action of the assistant push rod 21, the push rod 23 moves along the inner wall of the glass tube 18 to the opening of the glass tube 18. The tobacco material is loaded into the glass tube via the opening. The silicone ring 19 is disposed in the top opening of the assistant push rod 21 and between the assistant push rod 21 and the push rod 23, so that owing to the frictional force, the movement of the assistant push rod 21 drives the push rod 23 to move, too. The fifth seal ring 22 is disposed around the push rod 23 and abuts against one end of the assistant push rod 21 to seal the bottom opening of the assistant push rod 21. The fourth seal ring 17 is disposed on one end of the slidable cylinder 13 to seal the top opening of the glass tube 18. The bottom opening of the slidable cylinder 13 is located in the top opening of the glass tube 18, and the second halves of the assistant push rod 21 and the push rod 23 are disposed in the slidable cylinder 13. The third seal ring 16 is disposed between the bottom end of the slidable cylinder 13 and the assistant push rod 21. The push button 14 extends from the guide groove of the slidable cylinder 13 to abut against the top end of the assistant push rod 21 and is fixed by the screw 15. The push button 14 moves in the guide groove of the slidable cylinder 13 to control the movement of the assistant push rod 21. The location pin 20 is fixed on the bottom of the upper end of the assistant push rod 21. A plurality of continuous small grooves is disposed at the bottom of the inner wall of the slidable cylinder 13 and matches the location pin 20 for controlling the forward distance of the assistant push rod 21 to ensure the output amount of the tobacco material for each push. The push rod 23 comprises a hollow structure comprising the air passage and the bottom end thereof comprises a plurality of evenly distributed through holes. The second seal ring 12 is disposed in the fixed base 10 to seal the connection region between the fixed base 10 and the top end of the push rod 23. The fixed base 10 is disposed in the top opening of the slidable cylinder 13. The top end of the push rod 23 is sheathed with the second seal ring 12 disposed in the fixed base 10. The inner air tube 9 is disposed through the fixed base 10 and communicates with the push rod 23. The outer air tube 5 sleeves the inner air tube 9 and is fixed on the fixed base 10. The lower seal ring 7 sleeves the fixed base 10 to seal the bottom opening of the water-storage glass tube 6. The water-storage glass tube 6 is supported by the fixed base 10 and the outer air tube 5 is disposed in the water-storage glass tube 6. The inversion valve 8 is disposed on the top of the inner air tube 9 and between the inner air tube 9 and the outer air tube 5 to block the water in the water-storage glass tube 6 and prevent the water from entering the inner air tube 9. The outer wall of the outer air tube 5 comprises at least one through hole for smoke discharge. The lower part of the mouthpiece holder 4 comprises a vent hole, and the upper part of the mouthpiece holder 4 is disposed in the top opening of the water-storage glass tube 6; the lower part is fixed in the top opening of the outer air tube 5. The upper seal ring 3 is disposed between the upper part of the mouthpiece holder 4 and the top end of the water-storage glass tube 6 to seal the top opening of the water-storage glass tube 6. The check valve 2 is disposed in the mouthpiece to block the reverse air, thus preventing the air reversing from the mouthpiece 1 from entering the water storage glass tube 6. The mouthpiece 1 is disposed on the mouthpiece holder 4. The sixth seal ring 25 is disposed in the base 26 to seal the bottom opening of the metal tube 24. The base 26 is disposed in the bottom opening of the metal tube 24. After use, the metal tube 24 sleeves the glass tube 18 and the slidable cylinder 13, and the top end of the metal tube 24 is fixed on the fixed base 10 to protect the glass tube 18 and isolate the air and quench the tobacco material. The first seal ring 11 is disposed between the base 10 and the top end of the metal tube 24 to seal the top opening of the metal tube 24.

The following advantages are associated with the hookah of the disclosure:

1. The hookah comprises a push rod disposed in the glass tube and is movable in the inner wall of the glass tube. A plurality of continuous small grooves is disposed on the inner wall of the slidable cylinder and matches the location pin for controlling the forward distance of the assistant push rod to ensure the output amount of the tobacco material for each push.
2. The hookah comprises a metal tube. After use, the metal tube sleeves the glass tube and the slidable cylinder, and the top end of the metal tube is fixed on the fixed base to protect the glass tube.
3. The hookah comprises a check valve disposed in the mouthpiece to block reverse air, thus preventing the air reversing from the mouthpiece from entering the water storage glass tube.

It will be obvious to those skilled in the art that changes and modifications may be made, and therefore, the aim in the appended claims is to cover all such changes and modifications.

What is claimed is:

1. A hookah, comprising a glass tube, a push rod having an air passage, and an assistant push rod; the glass tube, the push rod, and the assistant push rod being arranged such that the assistant push rod sleeves only a first half of the push rod which is movably disposed inside the glass tube and configured to move along an inner wall thereof upon an action of the assistant push rod, and a space is formed between a bottom opening of the glass tube and a bottom end of the push rod; wherein, when in use, tobacco material is loaded both in the glass tube and in the space, and wherein smoke produced by atomization of the tobacco material flows in the air passage of the push rod.

2. The hookah of claim 1, further comprising a silicone ring, wherein the silicone ring is disposed in a top opening of the assistant push rod and between the assistant push rod and the push rod, so that owing to a frictional force, a movement of the assistant push rod drives the push rod to move.

3. The hookah of claim 2, further comprising a slidable cylinder, a push button, and a screw, wherein the assistant push rod is disposed in the slidable cylinder; a bottom opening of the slidable cylinder is located in a top opening of the glass tube; the push button extends from a guide groove of the slidable cylinder to abut against a top end of the assistant push rod and is fixed by the screw; the push button moves in the guide groove of the slidable cylinder to control the movement of the assistant push rod.

4. The hookah of claim 3, further comprising a location pin, wherein the location pin is disposed on the assistant push rod; a plurality of continuous grooves is disposed on an inner wall of the slidable cylinder and matches the location pin for controlling a forward distance of the assistant push rod to ensure an output amount of the tobacco material for each push.

5. The hookah of claim 3, further comprising an outer air tube, a water-storage glass tube, an inner air tube, and a fixed base, wherein the fixed base is disposed in a top opening of the slidable cylinder; a top end of the push rod is sheathed with a second seal ring disposed in the fixed base; the inner air tube is disposed through the fixed base and communicates with the push rod; the outer air tube sleeves the inner air tube and is fixed on the fixed base; a lower seal ring sleeves the fixed base to seal a bottom opening of the water-storage glass tube; the water-storage glass tube is supported by the fixed base and the outer air tube is disposed in the water-storage glass tube.

6. The hookah of claim 5, further comprising an inversion valve disposed on a top of the inner air tube and between the inner air tube and the outer air tube to block water in the water-storage glass tube and prevent the water in the water-storage glass tube from entering the inner air tube.

7. The hookah of claim 6, wherein an outer wall of the outer air tube comprises at least one through hole for smoke discharge.

8. The hookah of claim 7, further comprising a mouthpiece, a check valve, and a mouthpiece holder, wherein a lower part of the mouthpiece holder comprises a vent hole, and an upper part of the mouthpiece holder is disposed in a top opening of the water-storage glass tube; the lower part of the mouthpiece holder is fixed in a top opening of the outer air tube; the check valve is disposed in the mouthpiece to block reverse air, thus preventing air reversing from the mouthpiece from entering the water storage glass tube; and the mouthpiece is disposed on the mouthpiece holder.

9. The hookah of claim 8, further comprising a metal tube, wherein after use, the metal tube sleeves the glass tube and the slidable cylinder, and a top end of the metal tube is fixed on the fixed base to protect the glass tube and quench the tobacco material.

10. The hookah of claim 1, wherein the push rod comprises a hollow structure comprising the air passage and the bottom end of the push rod comprises a plurality of evenly distributed through holes.

* * * * *